US006357625B2

(12) United States Patent
Kimble et al.

(10) Patent No.: US 6,357,625 B2
(45) Date of Patent: Mar. 19, 2002

(54) DISPENSING PACKAGES FOR FLUENT PRODUCTS

(75) Inventors: Bradley J. Kimble, Holland; John W. Safian, Maumee; Robert E. Harman, Perrysburg, all of OH (US)

(73) Assignee: Owens-Brockway Plastics Products Inc., Toledo, OH (US)

( * ) Notice: Subject to any disclaimer, the term of this patent is extended or adjusted under 35 U.S.C. 154(b) by 0 days.

(21) Appl. No.: 09/911,915

(22) Filed: Jul. 24, 2001

Related U.S. Application Data

(62) Division of application No. 09/479,138, filed on Jan. 7, 2000.

(51) Int. Cl.[7] ..... B67B 7/00
(52) U.S. Cl. ..... 222/1; 222/212; 222/556
(58) Field of Search ..... 222/1, 556, 212

(56) References Cited

U.S. PATENT DOCUMENTS

| | | | |
|---|---|---|---|
| 1,033,688 | A | 7/1912 | Fuchs |
| 1,033,689 | A | 7/1912 | Fuchs |
| 1,102,302 | A | 7/1914 | Slade |
| 1,173,546 | A | 2/1916 | Baron |
| 1,666,743 | A | 4/1928 | Klopsteg |
| 1,861,602 | A | 6/1932 | Koze |
| 1,925,926 | A | 9/1933 | Kunkel |
| 2,272,867 | A | 2/1942 | Cobel |
| 2,312,380 | A | 3/1943 | Bernhardt |
| 2,361,958 | A | 11/1944 | Nyden |
| 2,391,345 | A | 12/1945 | Punte |
| 2,474,678 | A | 6/1949 | Kitchen |
| 2,484,148 | A | 10/1949 | Beatty et al. |
| 2,574,422 | A | 11/1951 | Stoos, Jr. et al. |
| 2,575,106 | A | 11/1951 | Hermani |
| 2,694,511 | A | 11/1954 | Bogeaus et al. |
| 2,808,183 | A | 10/1957 | Olson et al. |
| 2,812,120 | A | 11/1957 | Beall, Jr. |

(List continued on next page.)

FOREIGN PATENT DOCUMENTS

| | | |
|---|---|---|
| DE | 2120079 | 11/1972 |
| DE | 8815614 | 3/1989 |
| EP | 0591601 | 4/1994 |
| EP | 0791542 | 8/1997 |
| FR | 2609000 | 7/1988 |
| GB | 4771 | 12/1976 |

OTHER PUBLICATIONS

Photographs labeled "A" through "G" each showing three closure specimens.
Seaquist Closures Publications (2 sides) C–044/5M entitled "Disc Top Dispensing Closures" 1986.

*Primary Examiner*—Joseph A. Kaufman
*Assistant Examiner*—Melvin A. Cartagena

(57) ABSTRACT

A container and closure package for dispensing a fluent product that includes an integrally molded plastic container and a one-piece molded plastic closure. The closure is secured to the container within a recess in the upper portion of the container so that the closure conforms to the outlines of the container body. The closure has a base with an annular wall and an interior bead that is received by snap fit over an exterior bead on an annular wall surrounding the outlet opening of the container. A pair of laterally opposed aprons depend from the closure base, and have interior beads that are received by snap fit over exterior beads on the container for enhanced retention of the closure on the container. Strengthening webs extend along the recessed portion of the container to the annular wall surrounding the container outlet opening to strengthen the container against buckling during application of the closure. Gussets extend from the closure aprons to the annular wall of the closure base for rigidifying the closure base.

19 Claims, 4 Drawing Sheets

U.S. PATENT DOCUMENTS 2,894,660 A 7/1959 Gordon
2,961,133 A 11/1960 Ankney
3,078,497 A 2/1963 Micallef
3,094,256 A 6/1963 Ensch
3,131,824 A 5/1964 Van Baarn
3,135,441 A 6/1964 Wise et al.
3,157,322 A 11/1964 Bernhardt
3,201,011 A 8/1965 Brocken
D204,511 S 4/1966 Leeds et al.
3,252,632 A 5/1966 Hagenes
3,300,104 A 1/1967 Burt
3,302,835 A 2/1967 Eckles
3,303,971 A 2/1967 Stevens, Jr.
3,371,827 A 3/1968 Micallef
3,377,005 A 4/1968 Marder
3,383,019 A 5/1968 Waterman
3,400,866 A 9/1968 Fattori
3,429,488 A 2/1969 Micallef
3,471,066 A 10/1969 Micallef
3,484,027 A 12/1969 Micallef
3,516,581 A 6/1970 Micallef
3,539,075 A 11/1970 Bautista
3,542,256 A 11/1970 Waterman
3,642,179 A 2/1972 Micallef
3,653,546 A 4/1972 Hazard
D223,602 S 5/1972 Hoffman
D224,092 S 7/1972 Steidley
3,675,804 A 7/1972 Micalief
3,675,812 A 7/1972 Foster
3,702,165 A 11/1972 Carow et al.
3,734,359 A 5/1973 Waterman
3,771,685 A 11/1973 Micallef
3,785,528 A 1/1974 Mandeltort
3,847,313 A 11/1974 Micallef
3,853,250 A 12/1974 Alpern
D236,880 S 9/1975 Sway
3,948,422 A 4/1976 Micallef
3,957,181 A 5/1976 Hazard
3,967,764 A 7/1976 Hazard
4,006,836 A 2/1977 Micallef
4,015,756 A 4/1977 Beck
4,022,352 A 5/1977 Pehr
D245,225 S 8/1977 Lyons
4,158,902 A 6/1979 Chernack et al.
4,219,138 A 8/1980 Hazard
4,220,248 A 9/1980 Wilson et al.
4,291,818 A 9/1981 Nozawa et al.
RE30,861 E 2/1982 Krawagna
4,343,397 A 8/1982 Nozawa et al.
4,358,032 A 11/1982 Libit
4,371,095 A 2/1983 Montgomery et al.
4,377,247 A 3/1983 Hazard et al.
4,399,928 A 8/1983 Klingler
4,441,637 A 4/1984 Libit
4,487,342 A 12/1984 Shy
4,579,260 A 4/1986 Young et al.
4,598,839 A 7/1986 Dombroski et al.
4,625,898 A 12/1986 Hazard
4,645,086 A 2/1987 Rosenthal
4,678,107 A 7/1987 Ennis, III
4,732,303 A 3/1988 Wang
4,776,501 A 10/1988 Ostrowsky
4,793,502 A 12/1988 Beck
4,815,616 A 3/1989 Silvenis
4,838,460 A 6/1989 Moore et al.
4,848,601 A 7/1989 Reil
4,861,541 A 8/1989 Kaminski et al.
4,911,635 A 3/1990 Kaminski et al.
4,962,869 A 10/1990 Gross et al.
4,978,035 A 12/1990 Morane et al.
4,982,882 A 1/1991 Gueret
5,022,566 A 6/1991 Song et al.
5,022,567 A 6/1991 Frazer
5,052,595 A 10/1991 Mon
5,054,662 A 10/1991 Santagiuliana
5,058,775 A 10/1991 Gross et al.
5,065,912 A 11/1991 Rosenthall
D325,164 S 4/1992 Cann et al.
5,105,989 A 4/1992 Gutkowski
5,123,561 A 6/1992 Gross
5,147,072 A 9/1992 Dirksing
5,192,005 A 3/1993 Zimmerman
5,201,440 A 4/1993 Gross
5,213,235 A 5/1993 Miranda
5,236,107 A 8/1993 Spaanstra, Sr.
5,242,079 A 9/1993 Stephens et al.
5,259,538 A 11/1993 Tardif
5,279,451 A 1/1994 Mueller et al.
5,284,264 A 2/1994 Gross
5,314,093 A 5/1994 Gross et al.
5,341,960 A 8/1994 Lay
5,346,100 A 9/1994 Lay
D353,332 S 12/1994 Behm et al.
5,370,277 A 12/1994 Wallis
5,370,284 A 12/1994 Dirksing
5,482,172 A 1/1996 Braddock
5,544,790 A 8/1996 Lu
5,918,777 A 7/1999 Flak

DISPENSING PACKAGES FOR FLUENT PRODUCTS

This application is a division of application Ser. No. 09/479,138 filed Jan. 7, 2000.

The present invention is directed to dispensing packages for fluent products such as viscous liquid products, and more particularly to a package that includes an integrally molded plastic container and a closure with dispensing valve integrated into the contours ofthe container.

BACKGROUND AND SUMMARY OF THE INVENTION

U.S. Pat. No. 5,918,777, assigned to the assignee of the present application, discloses a dispensing package and method of manufacture in which the package includes an integrally molded plastic container having a recessed surface with dispensing opening in the upper portion of the container, and a closure secured within the recess and having a valve element for selectively closing and opening the container outlet to dispense product. In some embodiments disclosed in the noted patent, the closure is of integrally molded plastic construction, having a base secured over the container dispensing opening within the recessed portion of the container, and a valve element coupled to the base by an integral hinge for selectively opening and closing the package.

Although the dispensing package and method of manufacture disclosed in the noted patent address and overcome problems theretofore extant in the art, further improvements are desirable. It is an object of the present invention to provide a container and closure package of the type disclosed in the above-noted patent that improves securement of the closure on the container to help prevent inadvertent disassembly of the closure from the container during handling or opening of the package or during dispensing of product from the package. Another object of the present invention is to provide a container and closure package ofthe type illustrated in the noted patent that is characterized by increased strength in the container around the dispensing opening so as to prevent distortion or collapse of the container due to top load forces during removal of moil flash from the container as molded or securement of the closure on the container. A further object of the invention is to provide a container and closure package of the type illustrated in the above-noted patent in which the closure exhibits increased strength and reduced susceptibility to process variations during manufacture. Yet another object ofthe present invention is to provide a container for use in such a package, a closure for use in such a package, and a method of forming such a package.

A container and closure package for dispensing a fluent product in accordance with one aspect of the present invention includes an integrally molded plastic container having a flexible body and a recessed portion in the upper exterior of the container body. The recessed portion of the container has a base wall, at least one sidewall extending upwardly from the base wall, an outlet opening in the base wall, and laterally opposed recessed side portions extending from the base wall and being recessed inwardly from the sidewall portion of the container body. A closure is secured to the container in the recessed portion of the container in communication with the outlet opening. The closure has a valve movable from a closed to an open position to dispense product from the interior ofthe container, and laterally opposed aprons that extend along the recessed side portions of the recessed portion of the container. In the preferred embodiment in accordance with this aspect of the invention, the recessed side portions of the container include respective exterior retention beads, and the closure aprons include respective interior retention beads that are secured over the exterior retention beads on the container for holding the closure on the container. The outlet opening in the recessed portion of the container is surrounded by an axial wall that has an exterior retention bead, and the closure has a complementary annular wall with an interior retention bead that is secured over the exterior retention bead on the outlet opening annular wall. Thus, in this preferred embodiment, the beads on the annular walls surrounding the container outlet opening, and the beads on the closure aprons and container sidewall portions, cooperate to retain the closure on the container during handling ofthe package, during opening of the package during use, and during dispensing of fluent product from the package.

A container and closure package for dispensing fluent product in accordance with a second aspect of the present invention, which may be implemented separately from or more preferably in combination with other aspects of the invention, includes an integrally molded plastic container having a flexible body and a recessed portion in the upper exterior of the container body. The recessed portion has a base wall, at least one sidewall extending upwardly from the base wall, an outlet opening in the base wall surrounded by an annular wall, and a raised web extending along the base wall from the at least one sidewall to the annular wall that surrounds the outlet opening. A closure is secured to the container in the recessed portion of the container in communication with the outlet opening, and includes a valve movable from a closed position to an open position to dispense product. In the preferred embodiment of the invention, the recessed portion of the container is defined in part by a pair of opposed sidewalls that extend upwardly from the base wall, and a raised web extends from each sidewall to the annular wall that surrounds the dispensing opening. These raised webs increase the strength of the container around the annular wall that surrounds the outlet opening to prevent distortion and buckling during application of top load forces during removal of moil flash following molding of the container, and during application of the closure to the container.

In accordance with a third aspect of the present invention, which again may be implemented separately from or more preferably in combination with other aspects of the invention, at least one gusset or rib extends from each closure apron radially inwardly to the closure annular wall that is received over the annular wall surrounding the container outlet opening. In the preferred embodiment of the invention, a pair of spaced gussets or ribs extend along the underside of the closure from each closure apron to the opposing surface of the closure annular wall. These gussets increase the strength of the closure base against buckling or distortion during application to the container and during use, and help to reduce variations in closure operating characteristics due to tolerance variations during the manufacturing process.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
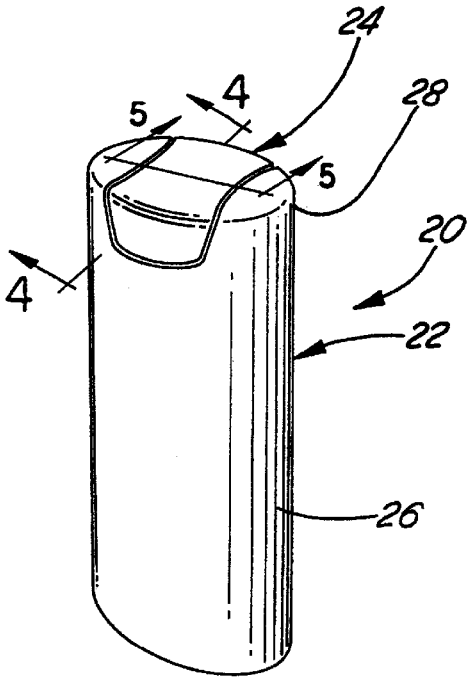
FIG. 1 is a perspective view of a container and closure package in accordance with one presently preferred embodiment of the invention.
Figure 2:
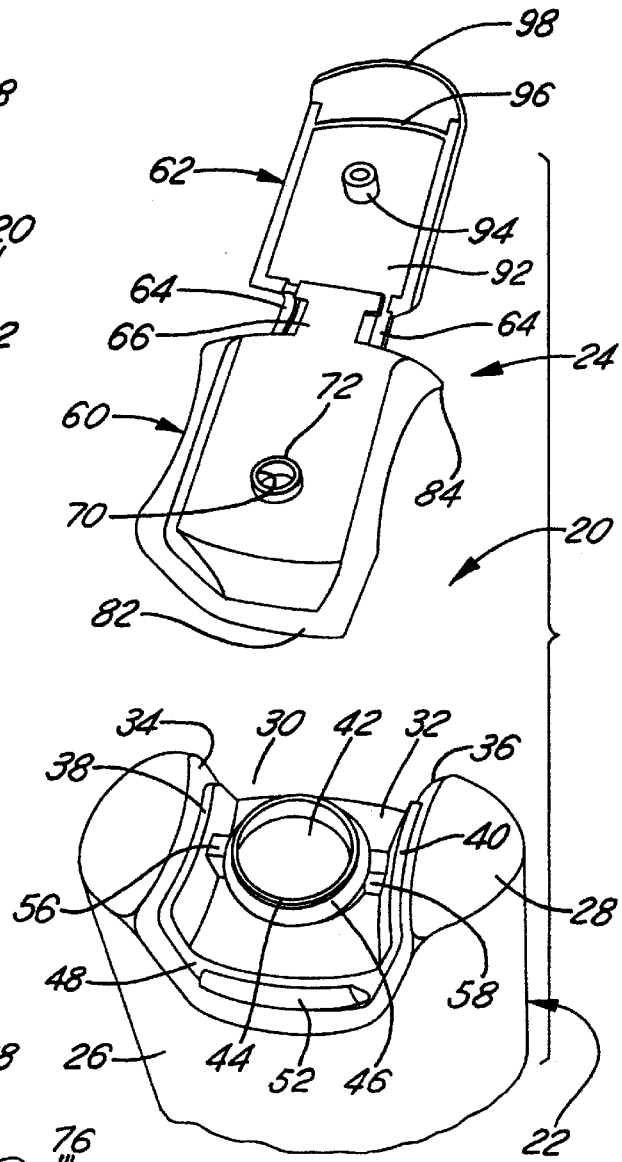
FIG. 2 is a fragmentary exploded perspective view of the container and closure package illustrated in FIG. 1.
Figure 3:
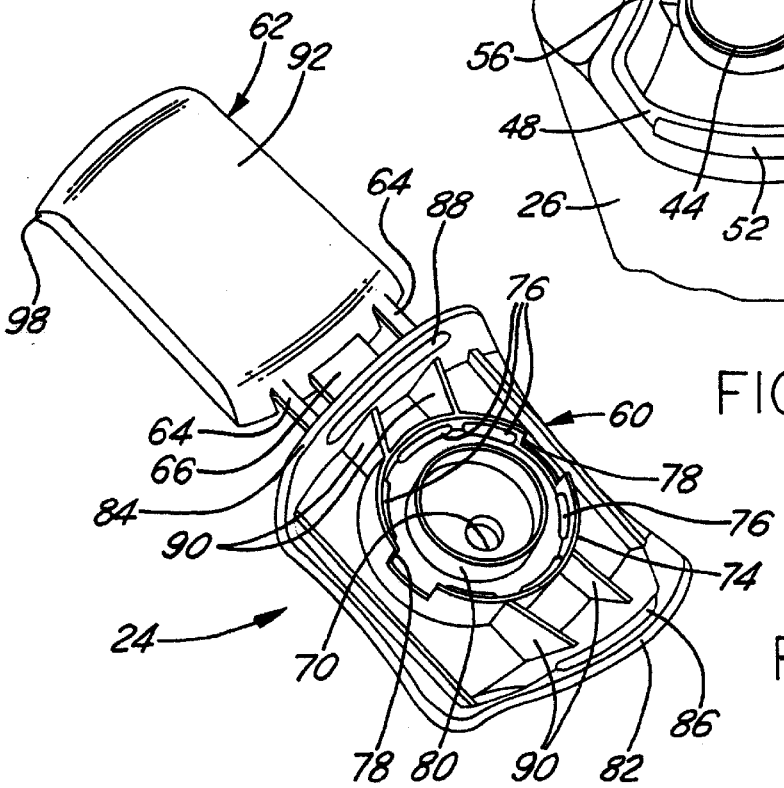
FIG. 3 is a perspective view of the underside of the closure illustrated in FIG. 2.

The disclosure of above-noted U.S. Pat. No. 5,918,777 is incorporated herein by reference.

FIGS. 1–2 and 4–5 illustrate a container and closure package 20 for dispensing a fluent product in accordance with one presently preferred embodiment ofthe invention. Package 20 includes a container 22 and a dispensing closure 24. Container 22 is of integrally molded plastic construction, and includes a sidewall portion 26, an upper exterior portion 28 and a recessed portion 30 inwardly recessed with respect to the upper exterior portion. Recessed portion 30 is defined by an outwardly convex base wall 32, and a pair of opposed outwardly convex sidewalls 34, 36 that extend upwardly at an outward angle from base wall 32. Each sidewall 34, 36 has an associated shoulder 38,40 against which closure 24 rests. A circular outlet opening 42 is centrally disposed in base wall 32, and is surrounded by an annular wall 44 that projects upwardly from base wall 32. An exterior bead 46 surrounds annular wall 44.

Figure 5:
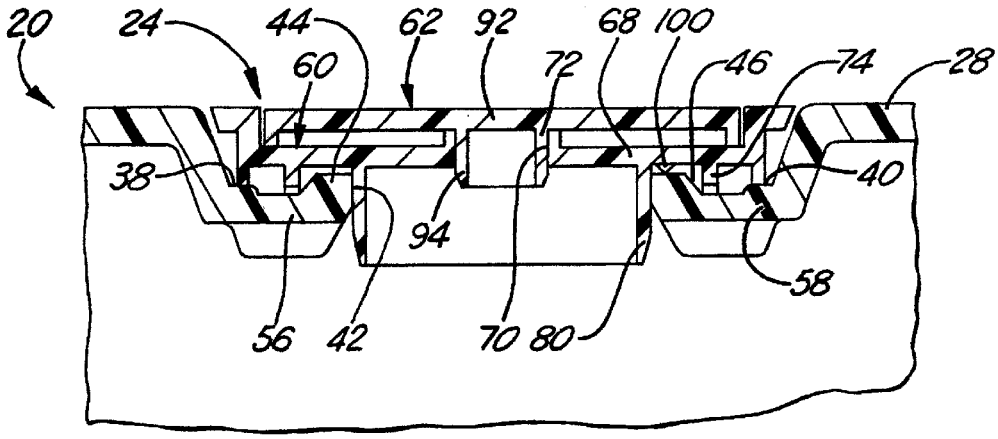
Figure 6:
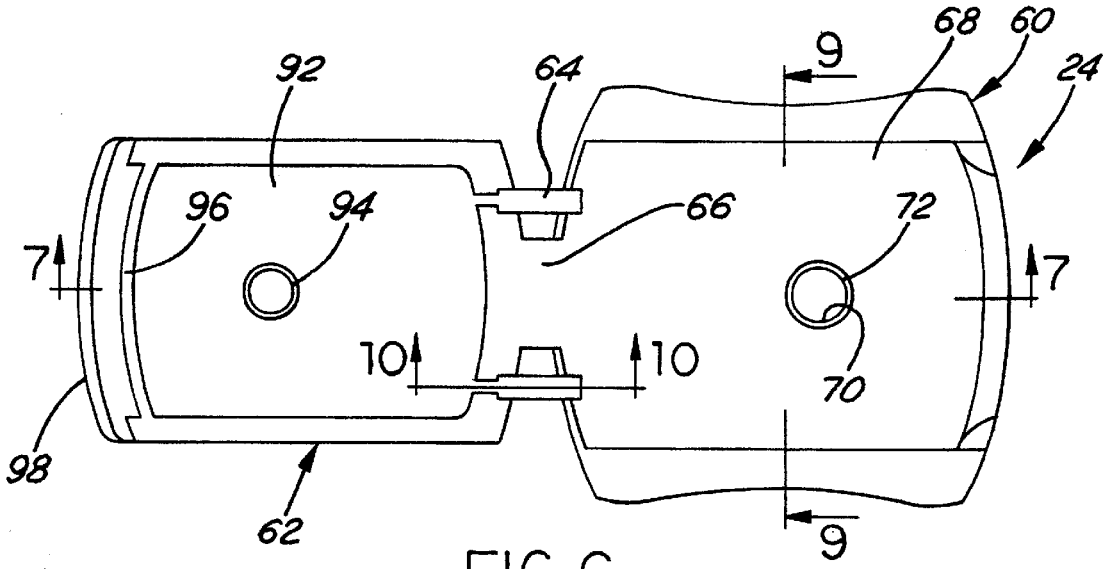
FIG. 6 is a top plan view of the closure illustrated in FIGS. 1–5.
Figure 7:
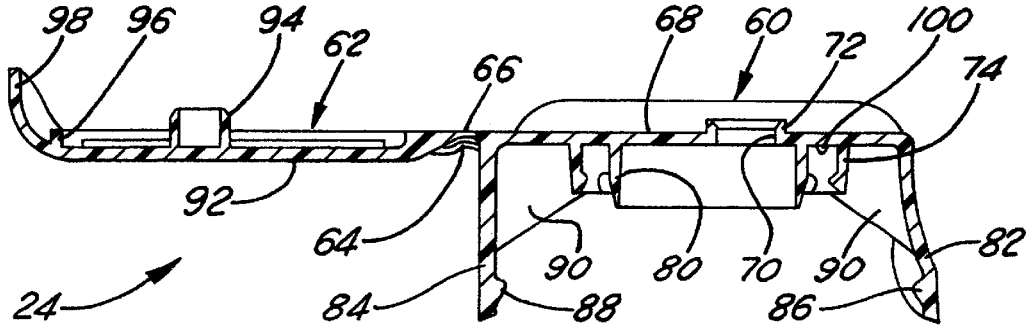
FIG. 7 is a sectional view taken substantially along the line 7—7 in FIG. 6.
Figure 8:
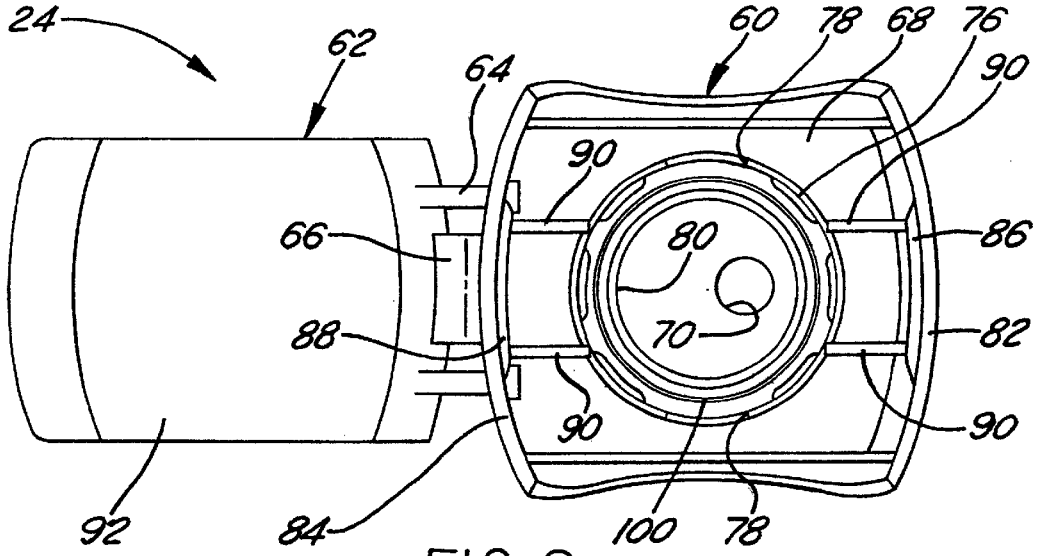
FIG. 8 is a bottom plan view of the closure illustrated in FIGS. 6–7.
Figure 9:
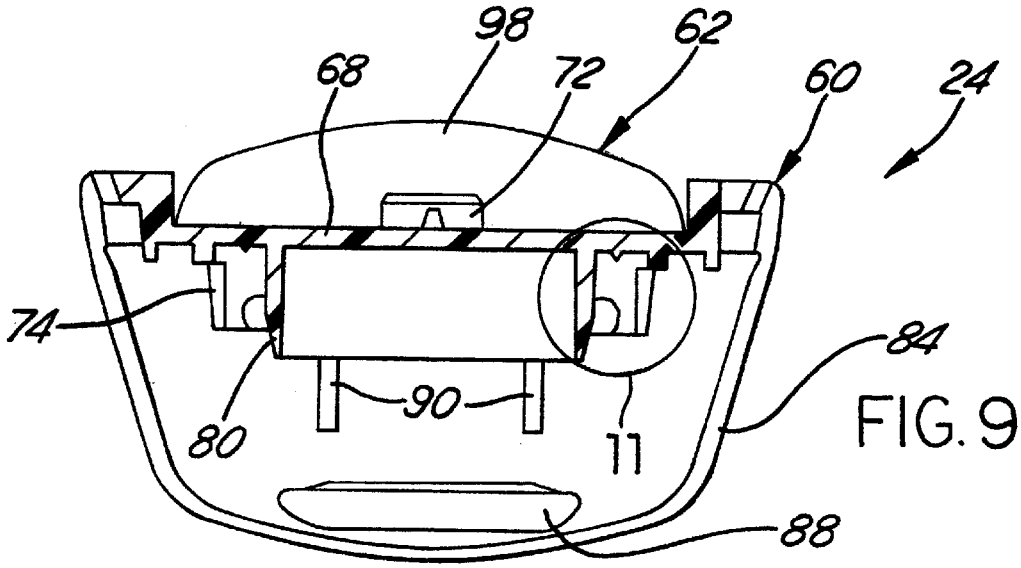
FIGS. 9 and 10 are sectional views taken substantially along the respective lines 9—9 and 10—10 in FIG. 6.
Figure 10:
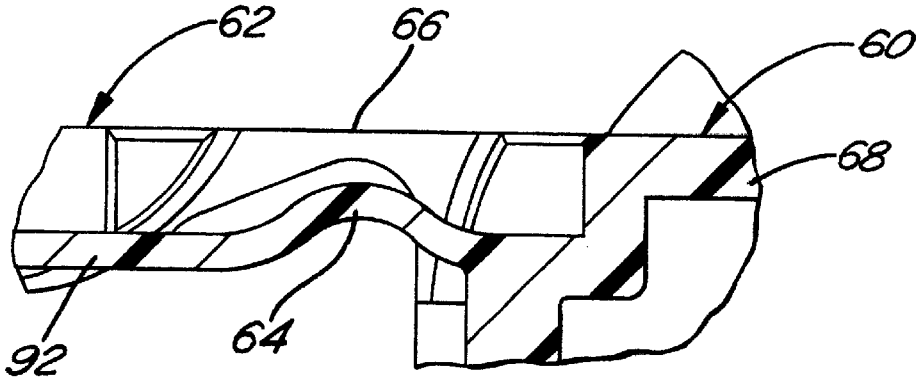
Figure 11:
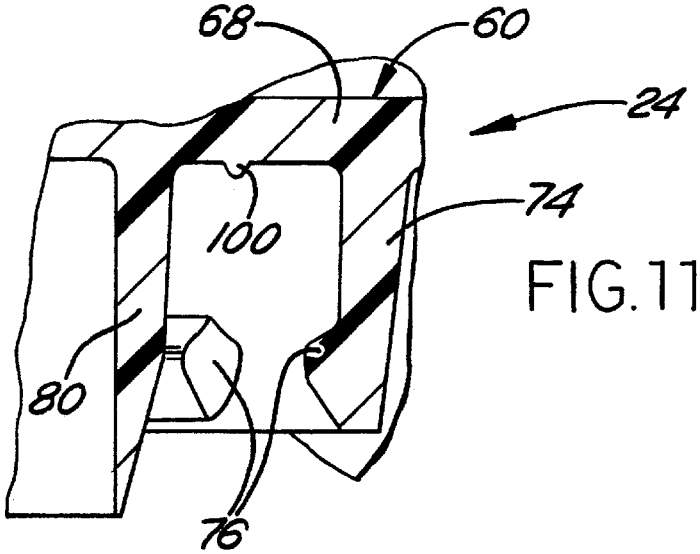
FIG. 11 is a fragmentary sectional view of the portion of FIG. 9 within the circle 11.

A pair of laterally opposed recessed side portions 48,50 extend from base wall 32 and are recessed inwardly with respect to the sidewall of container body portion 26. Thus, recessed portion 30 is recessed both with respect to the axial end portion 28 of container 22 and with respect to the sidewall portion of container 22. An exterior bead 52, 54 extends laterally along respective associated recessed side portions 48, 50. Beads 52, 54 preferably are linear and disposed in a common plane parallel to but spaced from the upper edge of outlet annular wall 44. A rectangular web 56, 58 extends radially inwardly from respective associated sidewalls 34, 36 to the opposing surface of annular wall 44 that surrounds outlet opening 42. As best seen in FIG. 5, webs 56, 58 terminate at annular wall 44 beneath the level of bead 46, with the lower edge of bead 46 merging into webs 56, 58. Webs 56, 58 have a hollow underside and are aligned with each other diametrically of wall 44. Container 22 is preferably blow molded of integral plastic composition such as high density polyethylene, for example.

Closure 24, which may be injection molded of polypropylene, for example, includes a base 60 and a closure valve 62 integrally coupled to base 60 by hinge elements 64,66. Closure base 60 includes a flat base wall 68 in which an outlet opening 70 is surrounded by an upstanding annular wall 72. A first annular wall 74 depends from closure base wall 68, and has a segmented annular bead 76 formed on the interior surface thereof. Interruptions 78 in annular wall 74 fit over webs 56, 58 of container 22 in assembly of closure 24 to container 22, as will be described. A circumferentially continuous second annular wall 80 depends from closure base wall 68 radially inwardly from annular wall 74 for sliding plug-sealing engagement with the inside diameter of container outlet opening 42. A pair of laterally opposed aprons 82, 84 depend from opposed edges of closure base wall 68. Each apron 82, 84 is inwardly concave and has an associated interior bead 86, 88, which are coplanar with each other and spaced from base wall 68 such that beads 86, 88 are received by snap fit over container beads 52, 54 to secure closure 24 on container 22.

Figure 4:
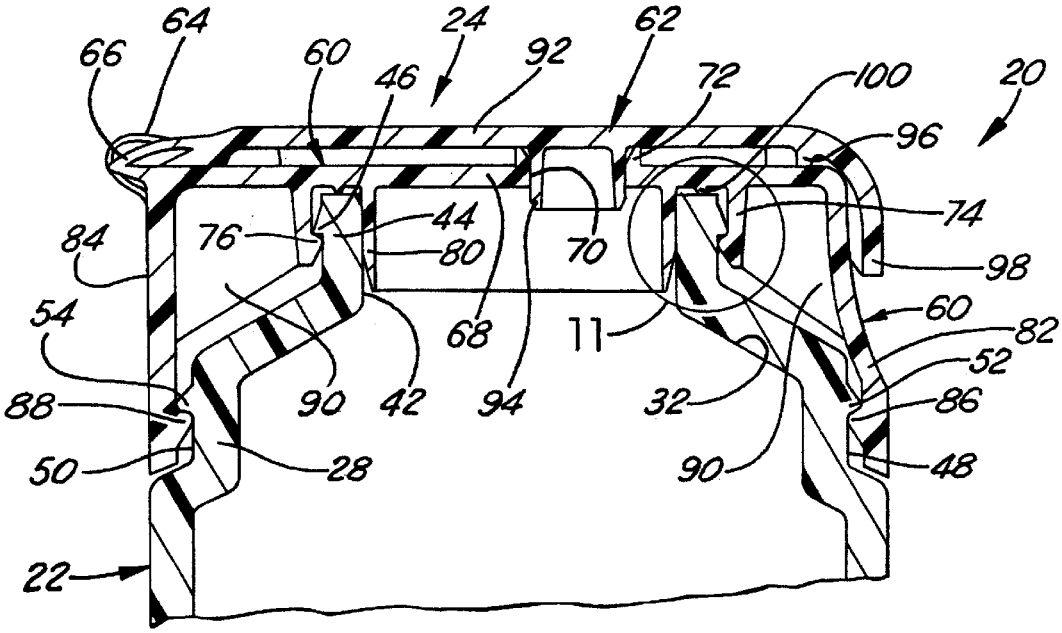
FIGS. 4 and 5 are fragmentary sectional views taken substantially along the lines 4—4 and 5—5 in FIG. 1.

A pair of spaced parallel gussets or ribs 90 extend radially inwardly along the underside of base wall 68 from each apron 82, 84 to the opposing surface of annular wall 74. As best seen in FIG. 4, the edges of gussets 90 spaced from base wall 68 are angulated to follow the contour of container recess base wall 32. Valve 62 has a base wall 92 from which an annular wall 94 extends for plug-sealing engagement within annular wall 72 that defines and surrounds closure outlet opening 70. A rib 96 on the underside of base wall 92 spaces base wall 92 from base wall 68 in the closed position of valve 62, as best seen in FIG. 4. Base wall 92 terminates in a downwardly projecting lip 98 that extends along apron 82 for grasping by a user to open closure valve 62 with respect to closure base 60. An annular bead 100 depends from base wall 68 between annular walls 74, 80 for sealing engagement with the upper edge surface of outlet wall 84 of container 22, as best seen in FIGS. 4 and 5.

Container 22 and closure 24 are formed separately in suitable molding operations, container 22 is trimmed as required, and container 22 and closure 24 are then secured to each other after the package is filled with product. Closure 24 is assembled over wall 44 of container 22 within recessed portion 30 in the upper portion of the container. Segmented bead 76 on annular wall 74 of closure 24 is received by snap fit over bead 46 on annular container outlet wall 44. Interruptions 78 in closure annular wall 74 fit over webs 56, 58 of container 22 without interfering with the webs. Closure aprons 82, 84 extend downwardly through recessed side portions 48, 50 of container 22, and apron beads 86, 88 snap over beads 52, 54 on container 22. The combination of beads 44, 76 surrounding the container outlet opening and beads 52, 54, 86, 88 at the closure aprons improves retention of closure 24 on container 22 during handling and opening of the container by an operator, and during dispensing of product from within the container. Webs 56, 58 strengthen the upper portion of the container against buckling or collapse as closure 24 is applied to container 22. The webs also make removal of the moil (molded with the container) easier because part of the flash can be left in the container. The moil can thus be removed by hand, or by simplified deflashing equipment. Webs 56, 58 also form interior channels for flow of product to outlet opening 42 from the elevated shoulders at each side of recessed portion 30. Gussets 90 extending between closure annular wall 74 and closure aprons 82, 84 improve rigidity of closure base 60 and help hold aprons 82, 84 against the opposing portions of the container.

There have thus been disclosed a container and closure package, a container, a closure and methods of making the same, which fully satisfy all ofthe objects and aims previously set forth. Modifications and variations will readily suggest themselves to persons of ordinary skill in the art. The invention is intended to embrace all such modifications and variations as fall within the spirit and broad scope of the appended claims.

What is claimed is:

1. A method of making a dispensing package for a fluent product, which comprises the steps of:

(a) forming an integrally molded plastic container having a flexible body with a body sidewall portion, an upper exterior portion and a recessed portion inwardly recessed with respect to said upper exterior portion, said recessed portion having a base wall, at least one sidewall extending upwardly from said base wall, an outlet opening in said base wall, laterally opposed recessed side portions extending from said base wall and being recessed inwardly from said body sidewall portion, and exterior retention beads in said recessed side portions, (b) forming a closure having a valve movable from a closed to an open position for dispensing product, laterally opposed aprons and interior retention beads on said aprons, and (c) securing said closure within said recessed portion of said container with said aprons extending within said recessed side portions of said recessed portion of said container and said interior retention beads on said aprons received over said exterior retention beads in said recessed side portions.

2. The method set forth in claim 1 wherein said step (a) includes forming an annular wall on said base wall surrounding said outlet opening and exterior bead extending around said wall, wherein said step (b) includes forming an annular wall on said closure with an exterior retention bead, and wherein said step (c) includes securing said bead on said closure annular wall over said bead on said base wall annular wall.

3. The method set forth in claim 2 wherein said step (a) further includes forming a raised web along said base wall from said sidewall to said annular wall in said recessed portion, wherein said step (b) includes forming an interruption in said annular wall on said closure, and wherein said step (c) includes fitting said interruption over said web.

4. The method set forth in claim 2 wherein said step (b) includes forming at least one strengthening gusset interiorly extending from said apron to said annular wall on said closure.

5. The method set forth in claim 4 wherein said step (b) includes forming a spaced pair of strengthening gussets extending from each said apron to said annular wall in said closure.

6. A method of making a container and closure package for dispensing a fluent product, which comprises the steps of:

(a) forming an integrally molded plastic container having a flexible body with a body sidewall portion, an upper exterior portion and a recessed portion inwardly recessed with respect to said upper exterior portion, said recessed portion having a base wall, at least one sidewall extending upwardly from said base wall, an outlet opening in said base wall surrounded by an annular wall, and a raised web extending along said base wall from said at least one sidewall to said annular wall surrounding said outlet opening, (b) forming a closure having a valve movable from a closed to an open position or dispensing product, and (c) securing said closure within said recessed portion of said container.

7. The method set forth in claim 6 wherein said step (a) includes forming said recessed portion of said container to include two said sidewalls on opposite sides of said recessed portion and two of said raised webs extending along said base wall from said two sidewalls to said annular wall surrounding said outlet opening.

8. The method set forth in claim 6 wherein said step (a) is such that said annular wall in said recessed portion includes an exterior bead, wherein said step (b) is such that said closure includes an annular wall with an interior bead received in said step (c) over said exterior bead for holding said closure on said container, and wherein said annular wall on said closure has an interruption to fit over said raised web.

9. The method set forth in claim 6 wherein said step (a) is such that said recessed portion of said container includes laterally opposed recessed side portions extending from said base wall and being recessed inwardly from said body sidewall portion, and wherein said step (b) is such that said closure includes laterally opposed aprons that extend within said side portions of said recessed portion of said container following said step (c).

10. The method set forth in claim 9 wherein said step (a) is such that said recessed side portions include respective exterior retention beads, and wherein said step (b) is such that said aprons of said closure include respective interior beads received in said step (c) over said exterior retention beads for holding said closure on said container.

11. A method of making a container that comprises the step of: integrally molding a plastic container having a flexible body with a body sidewall portion, an upper exterior portion and a recessed portion inwardly recessed with respect to said upper exterior portion, said recessed portion having a base wall, at least one sidewall extending upwardly from said base wall, an outlet opening in said base wall, laterally opposed recessed side portions extending from said base wall and being recessed inwardly from said body sidewall portion, and respective exterior beads on said side portions for retaining a closure on the container.

12. The method set forth in claim 11 wherein said outlet opening in said base wall is surrounded by an annular wall and an exterior bead on said annular wall, and a raised web extending along said base wall from said at least one sidewall to said annular wall surrounding said outlet.

13. The method set forth in claim 12 wherein said recessed portion of said container includes two of said sidewalls on opposite sides of said recessed portion and two of said raised webs extending along said base wall from said two sidewalls to said annular wall surrounding said outlet opening.

14. A method of making a container that comprises the step of: integrally molding a plastic container having a flexible body with a body sidewall portion, an upper exterior portion and a recessed portion inwardly recessed with respect to said upper exterior portion, said recessed portion having a base wall, at least one sidewall extending upwardly from said base wall, an outlet opening in said base wall surrounded by an annular wall, and a raised web extending along said base wall from said at least one sidewall to said annular wall surrounding said outlet opening.

15. The method set forth in claim 14 wherein said recessed portion of said container includes two of said sidewalls on opposite sides of said recessed portion and two of said raised webs extending along said base wall from said two sidewalls to said annular wall surrounding said outlet opening.

16. The method set forth in claim 14 wherein said annular wall in said recessed portion includes an exterior bead for holding a closure on said container.

17. The method set forth in claim 14 wherein said recessed portion of said container includes laterally opposed recessed side portions extending from said base wall and being recessed inwardly from said body sidewall portion.

18. The method set forth in claim 17 wherein said recessed side portions include respective exterior beads for retaining a closure on the container.

19. The method set forth in claim 18 wherein said outlet opening in said base wall is surrounded by an annular wall and an exterior bead on said annular wall, and a raised web extends along said base wall from said at least one sidewall to said annular wall surrounding said outlet opening.

* * * * *